US010443007B2

(12) United States Patent
D'Acosta et al.

(10) Patent No.: US 10,443,007 B2
(45) Date of Patent: Oct. 15, 2019

(54) HIGH-OCTANE UNLEADED AVIATION GASOLINE

(71) Applicant: Swift Fuels, LLC, West Lafayette, IN (US)

(72) Inventors: Chris D'Acosta, West Lafayette, IN (US); Thomas Albuzat, Homburg (DE)

(73) Assignee: Swift Fuels, LLC, West Lafayette, IN (US)

( * ) Notice: Subject to any disclaimer, the term of this patent is extended or adjusted under 35 U.S.C. 154(b) by 0 days.

(21) Appl. No.: 15/651,174

(22) Filed: Jul. 17, 2017

(65) Prior Publication Data

US 2018/0016509 A1 Jan. 18, 2018

Related U.S. Application Data

(60) Provisional application No. 62/363,466, filed on Jul. 18, 2016.

(51) Int. Cl.

| | |
|---|---|
| ***C10L 10/10*** | (2006.01) |
| ***C10L 1/16*** | (2006.01) |
| ***C10L 10/14*** | (2006.01) |
| ***C10L 1/06*** | (2006.01) |

(52) U.S. Cl.

CPC ..... *C10L 10/10* (2013.01); *C10L 1/06* (2013.01); *C10L 1/1608* (2013.01); *C10L 10/14* (2013.01); *C10L 2200/0423* (2013.01); *C10L 2270/023* (2013.01); *C10L 2270/04* (2013.01); *C10L 2300/40* (2013.01)

(58) Field of Classification Search

CPC combination set(s) only.
See application file for complete search history.

(56) References Cited

U.S. PATENT DOCUMENTS

| | | | | |
|---|---|---|---|---|
| 2011/0230686 | A1* | 9/2011 | Rusek | C10L 1/02 585/14 |
| 2012/0029251 | A1 | 2/2012 | Hemighaus et al. | |
| 2013/0111805 | A1 | 5/2013 | Mathur et al. | |
| 2014/0128644 | A1 | 5/2014 | Braly | |
| 2015/0113865 | A1 | 4/2015 | Shea et al. | |
| 2015/0175918 | A1* | 6/2015 | D'Acosta | C10L 1/06 585/14 |

* cited by examiner

*Primary Examiner* — Ellen M McAvoy
*Assistant Examiner* — Chantel L Graham
(74) *Attorney, Agent, or Firm* — Woodard, Emhardt, Henry, Reeves & Wagner, LLP

(57) ABSTRACT

Various compositions of matter, methods of making compositions of matter, and methods of using compositions of matter are disclosed. In some embodiments, compositions useful as aviation gasoline, sometimes called "avgas", are disclosed. In some embodiments, mesitylene is used in compositions of matter, Additives may be employed in the disclosed compositions of matter. In some embodiments, the composition of matter has a motor octane number of about 99 or higher. In some embodiments, the compositions of matter have reduced or no heteroatom constituents, and/or may have reduced or no metal constituents. In some embodiments, compositions of matter disclosed herein may have certain performance characteristics equal to better than currently available 100LL compositions.

7 Claims, 1 Drawing Sheet

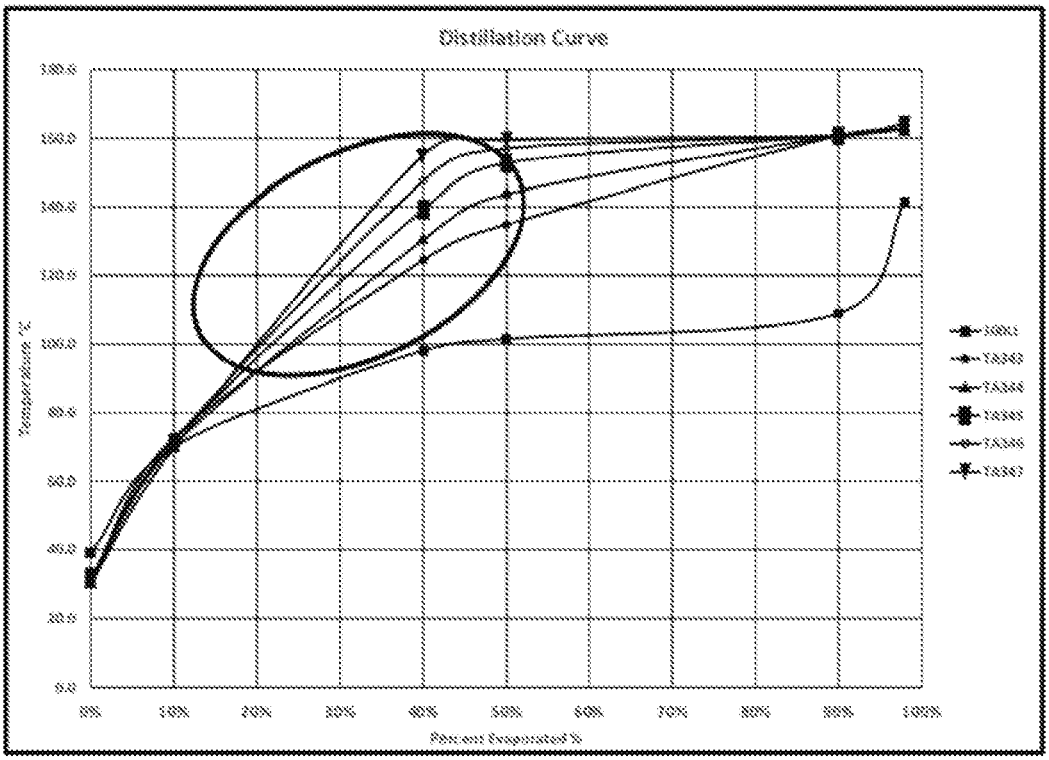
Distillation Curve
Temperature Above °C
Percent Evaporated %
0%
10%
20%
30%
40%
50%
60%
70%
80%
90%
100%

HIGH-OCTANE UNLEADED AVIATION GASOLINE

CROSS-REFERENCE TO RELATED APPLICATION

This application claims the benefit of priority of U.S. Provisional Patent Application No. 62/363,466 filed Jul. 18, 2016, which is hereby incorporated by reference in its entirety.

BACKGROUND

The composition of motor fuels vary based upon numerous parameters. For example, certain engine types may require certain types of fuels for optimal performance.

Motor fuel for engines used in planes are sometimes called Avgas.

There remains a need for improved compositions of motor fuels.

SUMMARY

In some embodiments, aviation gasoline complying with one or more ASTM fuel standards is disclosed.

In additional embodiments, compositions of matter comprise between about 55%-65% mesitylene. In certain embodiments, compositions of matter comprise C4 and/or C5 hydrocarbons. In further embodiments, compositions of matter may have motor octane numbers (MON) of at least about 99.8, a vapor pressure of about 38 to about 49 kPa, and/or a boiling point of below about 174° C.

In certain embodiments, a blend of C4, C5, and/or other hydrocarbons may be present in between about 10 to about 14 percent by mass, and/or between about 21 to about 35 percent.

Other embodiments are disclosed in the detailed description below.

BRIEF DESCRIPTIONS OF THE DRAWINGS

FIG. 1 shows a graph of distillation curves for various compositions of the present disclosure.

DETAILED DESCRIPTION

Swift Fuels has discovered the ideal formulation of unleaded aviation gasoline to replace 100LL. This comes many months after trying a wide range of hopeful chemicals and octane boosters to get the reciprocating piston engine to perform. Our fuel of choice is to use standard hydrocarbons with a minimum 55% m/m of mesitylene.

Why is Mesitylene (1,3,5-Trimethylbenzene) Important to Unleaded Avgas:

Mesitylene is a unique high-octane hydrocarbon molecule which when blended with other hydrocarbons into a fuel produces a slow-burning flame front in a piston engine cylinder—a feature which helps prevent early detonation within the cylinder. Using mesitylene as the primary means of achieving an octane boost in aviation gasoline results in an "all-hydrocarbon" formulation—eliminating the need for more highly toxic metals, aromatic amines and oxygenates.

Mesitylene has a boiling point at 167° C. and flash point at 50° C. which makes it slow to ignite at normal ambient temperatures (a fuel safety feature) and yet efficient at burning once ignited. Aircraft pilots typically desire a fuel that is effective at cold-starting (i.e. the engine ignites well in cold temperatures, including cold restarts at altitude) and in-flight hot-starting (ignites after the engine has been run 'hot', after which the fuel lines may have excess vapor from dissipated heat). The fuel blends we analyzed in our research were seeking to balance these two critical needs along with other factors and find the optimal blend to maximize the fuel's capability to perform ideally in all conditions.

Mesitylene has a relatively low toxicity (described by OSHA standards as an irritant) and a symmetrical structure which makes it ideal for material compatibility (e.g. our tests show that mesitylene has far less aggressive impact on the fuel system and supply chain infrastructure than aromatic amines which act like solvents). For this reason, all our recommended fuel blends categorically exclude the presence of any aromatic amines (e.g. aniline, m-toluidine, etc.)—as they tend to have a highly destructive impact on fuel-wetted aircraft parts. This in turn means that aromatic amines do not allow "drop-in ready" fuel alternatives, because many fuel parts tested in our research (e.g. o-rings, buna rubber hoses, fuels bladders, epoxy-lined filter housings, copper fuel lines, fabrics and polyester coatings, silicone-reinforced fuel flow dividers, etc.) tend to be damaged by use and therefore are recommended to be replaced prior to even using fuels with aromatic amines. Such equipment changes are a major expense and burden to owners of piston aircraft and help explain why the use of an "all-hydrocarbon" fuel is so important and advantageous to the industry. George Braly U.S. Pat. No. 8,628,594 uses aromatic amines seeking a drop-in ready fuel—our tests suggest this cannot be possible. Tim Shea (in 3 Shell patents) is proposing to commercialize aniline in transportation—our tests suggest this is highly dangerous and will carry unreasonable liability risks—the industry impact will be large.

Mesitylene is a $C_9$ hydrocarbon and when blended with the unique fuel formulation outlined below provides a boost to octane. The hydrocarbon combustion from the exhaust of an all-hydrocarbon fuel is far lower toxicity than emissions of lead from 100LL avgas. Mesitylene can be naturally metabolized by the body. Lead is a known neurotoxin—banned from most transportation fuels across the globe. Hydrocarbon exhaust is also safer than exhaust from octane additives like MMT and aniline- or m-toluidine-based fuels due to their higher risk to human health and toxicity to the environment.

This fuel contains no heteroatoms in the formula: no aromatic amines (which can act as solvents and destroys fuel system parts), no oxygenates (which tend to be water soluble; and have lower energy density; poor engine performance), and no metals in the formula (e.g. tetraethyl-lead, or MMT which have very high toxicity and environmental liability risk.)

Optimal Formulations for Unleaded Avgas:

The safest anti-detonation performance of a reciprocating piston engine is the gasoline formula with the highest motor octane—typically at or above 99.6 motor octane number. Experience has shown that the relationship to research octane number is also a factor as is the ability of the fuel to meet or exceed an ASTM supercharge rating of at least 130. These three octane ratings are all proxy's for the fuel's actual performance in the engine cylinder—which if performing ideally well, will not allow a detonation event to occur. (A detonation event is a premature explosion in the engine cylinder when the internal heat causes an explosion prior to the vaporized fuel being ready for the moment of combustion). Experience and testing by the FAA at the William J. Hughes Technical Center since 1993 has shown that out of 47 fuel blends attempting to replace 100LL with tetraethyllead, the unleaded fuels had to be at least 2 motor octane points higher than 99.6 to achieve the same anti-detonation performance of 100LL. (DOT/FAA/AR-08/40—Results show that the MON of the blends did trend with their detonation performance in the IO540-K engine, but equivalent unleaded blend performance of the specially blended 100LL required 2.0 greater MON. Nineteen of the 47 blends, all with higher than 102.5 MON, provided better detonation performance than the specially blended 100LL. Fourteen of the blends had higher MONs than the 100LL but performed worse in the full-scale engine.)

Swift Fuels has designed a unique all-hydrocarbon formulation comprising:

Mesitylene=45% to 80% (m/m) with 95% purity or better (all C9's; absence of ethylbenzenes)

Isooctane=8%-43% (m/m) with at least 99 MON, alkane blends must meet minimum octane Isopentane=9-11% (m/m)

Isobutane=2-3% (m/m)

The highest percentage of mesitylene produces a fuel with a minimum 102.5 MON, and the highest anti-detonation performance available using mesitylene (without other heteroatoms as octane boosters) in a wide range of reciprocating piston engines. The lowest percentage of mesitylene produces the least effective anti-detonation performance—below the current performance requirements of 100LL (leaded) avgas.

What this research discovered to our surprise is that the 2 extra MON is not required for the ideal blend to replace 100LL when using mesitylene in unleaded aviation gasoline. Our research shows that the critical range gets narrowed down as follows:

TABLE 1

Summary of Performance of Various Fuel Embodiments as compared to 100 LL Avgas

| | Fuel Performance vs. 100LL | | | | |
|---|---|---|---|---|---|
| | TA343 | TA344 | TA345 | TA346 | TA347 |
| % Mesitylene | 55.0% | 60.0% | 65.0% | 70.0% | 75.0% |
| % Isooctane | 33.0% | 28.0% | 23.0% | 18.0% | 13.0% |
| % IsoPentane | 10.0% | 10.0% | 10.0% | 10.0% | 10.0% |
| % IsoButane | 2.0% | 2.0% | 2.0% | 2.0% | 2.0% |
| MON | 99.8 | 100 | 100.2 | 100.7 | 101.3 |
| Density | 773.1 | 781.8 | 793.4 | 805.4 | 815.4 |
| Net Heat | 42.403 | 42.237 | 42.082 | 41.892 | 41.687 |
| Anti-Detonation | Less | Equal | Better | Better | Ideal |
| 100LL Mix 20%, 40%, 60%, 80% | OK | Better | Better | Better | Better |
| Engine Hot Start | OK | Better | Better | Better | Better |
| CGT (Combustion Gas Temp) | Ideal | OK | OK | OK | OK |
| EGT (Exhaust Gas Temp) | Ideal | OK | OK | OK | OK |
| Fuel Flow | Ideal | OK | OK | OK | OK |
| Engine Cold Start | Ideal | OK | OK | Poor | Poor |
| Throttle Response | Ideal | OK | OK | Poor | Poor |
| Material Compatibility | Ideal | OK | OK | OK | OK |
| Supply Chain Compatibility | Ideal | OK | OK | OK | OK |
| Environmental Compatibility | Ideal | OK | OK | OK | OK |
| FFP Hot/Cold | Ideal | OK | OK | OK | OK |

The ideal fuel formulation is the one that balances the anti-detonation performance under high stress while leaning the engine (a rare piloting event), offset by engine and fuel system considerations that pilots experience—like the impact of starting, operating temperatures, throttle response and fuel flows—during every flight. We expected the anti-detonation performance below 102.5 MON to be poor, however the engine performance did quite well (much better than expected) and the ASTM supercharge rating of all 5 mesitylene based fuels was very high, above 161 (vs. a minimum of 130 for 100LL).

FIG. 1 highlights the improved distillation properties that ease the engine starting properties of the fuel and make transient throttle response improve as well.

Engine Test Results

Engine testing over the past 4-5 years has shown that very-high levels of mesitylene (~80% m/m) in aviation gasoline formulations do indeed result in strong engine performance. However, this level is not a balanced solution given the other dimensions of engine performance that are required. Our research now points to the fact that levels of mesitylene as low as 55%-65% (m/m)—lower than expected—actually provide the optimal blend of operating characteristics for the largest group of US piston aircraft fleet. What was unexpected is that the supercharge rating of these lower percentage fuels actually exceeds 160 and the octane requirements of the engine were satisfied with 100 octane. (earlier research across the industry had suggested than unleaded fuels needed at least 2-3 motor octanes higher than 100LL to achieve the same overall engine performance—so all the fuel targets were set to 102+ MON. While there are some unique needs for ultra-high octane in WWII style radial aircraft that can benefit for 80% levels of mesitylene, more than 99+% of the piston fleet can use fuel with mesitylene levels between 55%-65% and have a very well-balanced high-octane fuel.

80% m/m Mesitylene

Excellent anti-detonation performance up to 10% better than 100LL

Excellent hot starting

Poor cold starting characteristics

Extreme seal swell up to 25% but no destructive impacts

Fuel bladder crinkling equal to 30% toluene baseline

Difficulty with engine throttle response

Difficulty with engine starting; requires special starting technique

65% m/m Mesitylene

Excellent anti-detonation performance up to 5-7% better than 100LL

Excellent hot starting

Good cold starting characteristics

Seal swell up to 15-20% but no destructive impacts

Fuel bladder crinkling less than 30% toluene baseline

Good with engine throttle response

Good with engine starting

60% m/m Mesitylene

Excellent anti-detonation performance +/−1% equivalent to 100LL

Excellent hot starting

Very good cold starting characteristics

Seal swell up to 15-20% but no destructive impacts

Fuel bladder crinkling less than 30% toluene baseline

Excellent with engine throttle response

Excellent with engine starting

55% m/m Mesitylene

Excellent anti-detonation performance +/−5% equivalent to 100LL

Excellent hot starting

Excellent cold starting characteristics; tested to start at −21° C.

Seal swell up to 15% but no destructive impacts

Fuel bladder crinkling far less than 30% toluene baseline

Excellent engine throttle response

Excellent with engine starting

CONCLUSIONS

The ideal unleaded high-octane avgas fuel formulations to replace 100LL is as follows:

60% Mesitylene—(Equal to 100LL Performance)
10% isopentane
2% isobutane
28% isooctane
Minimum 100 Motor octane number
65% Mesitylene—(Up to 5% Better than 100LL Performance)
10% isopentane
2% isobutane
23% isooctane
Minimum 100 Motor octane number
55% Mesitylene—(about 1-5% Less of 100LL Performance Depending Upon Engine Types)
10% isopentane
2% isobutane
33% isooctane
Minimum 99.8 Motor octane number

TABLE 2

Summary of Certain Embodiments.

| | TA343 | TA344 | TA345 | TA346 | TA347 |
|---|---|---|---|---|---|
| % Mesitylene | 55% | 60% | 65% | 70% | 75% |
| % Isooctane | 33% | 28% | 23% | 18% | 13% |
| % Pentane/IsoButane | 12% | 12% | 12% | 12% | 12% |
| MON | 99.8 | 100 | 100.2 | 100.7 | 101.3 |
| Density | 773.1 | 781.8 | 793.4 | 805.4 | 815.4 |
| Net Heat | 42.403 | 42.237 | 42.082 | 41.892 | 41.687 |

Other embodiments of the current disclosure include:

1) An aviation gasoline according to ASTM fuel standards comprising between 55%-65% mesitylene, a blend of C4/C5 hydrocarbons (typically isobutane and isopentane) for totaling 10-14% and between 21-35% alkanes (any appropriate use of isooctane, alkylates, isomerate, etc. with a motor octane number of 99 or higher) with a final fuel motor octane number of at least 99.8 MON and a vapor pressure of 38-49 kPa and a final boiling point below 174° C.
2) An aviation gasoline comprising 55%-65% mesitylene (m/m) with a minimum MON of 99.8.
3) The minimum mesitylene purity is 95% . . . (fuel may contain 0-3% pseudocumene)
4) An aviation gasoline comprising 55%-65% $C_9$ aromatics (m/m) with a minimum MON of 99.8
5) No heteroatoms in the formula: no aromatic amines (act as solvent and destroys fuel system parts)
6) No heteroatoms in the formula: no oxygenates (tend to be water soluable; poor performance)
7) No metals in the formula: no tetraethyllead, no MMT (very high toxicity; liability risk)

The invention claimed is:

1. An aviation gasoline according to ASTM fuel standards comprising between 55%-65% mesitylene, a blend of isobutane and/or isopentane totaling 10-14%, and between 21-35% alkanes with a final fuel motor octane number of at least 99.8 MON, a vapor pressure of 38-49 kPa, and a final boiling point below 174° C.

2. The aviation gasoline of claim 1, wherein the mesitylene contains up to 3% pseudocumene.

3. The aviation gasoline of claim 1, wherein there are no heteroatoms in the formula, no aromatic amines, no oxygenates, no metals in the formula, no tetraethyl lead, and no MMT.

4. The aviation gasoline of claim 1, wherein said mesitylene is present at about 55% (mass/mass).

5. The aviation gasoline of claim 1, wherein said mesitylene is present at about 60% (mass/mass).

6. The aviation gasoline of claim 1, wherein said mesitylene is present at about 65% (mass/mass).

7. The aviation gasoline of claim 1, wherein said alkanes comprise isooctane.

* * * * *